US006457710B1

(12) United States Patent
Bisbee et al.

(10) Patent No.: US 6,457,710 B1
(45) Date of Patent: Oct. 1, 2002

(54) MAGNETIC HOCKEY GAME

(75) Inventors: Edward Bisbee, Hamilton; Brendan Lowe, Burlington, both of (CA)

(73) Assignee: Wee Play 'Kids at Heart' Inc., Dundas (CA)

( * ) Notice: Subject to any disclaimer, the term of this patent is extended or adjusted under 35 U.S.C. 154(b) by 0 days.

(21) Appl. No.: 09/764,257

(22) Filed: Jan. 19, 2001

(51) Int. Cl.[7] ..... A63F 7/06; A63B 67/04

(52) U.S. Cl. ..... 273/108.1; 273/108.5; 273/108.56; 273/119 A; 273/456; 273/443; 273/126 A

(58) Field of Search ..... 273/118 A, 126 A, 273/119 A, 129 L, 239, 108.1, 126 R, 119 R, 108.3, 108.31, 108.32, 407, 408, 410, 403, 404, 317.1, 108.5, 108.56, 456, 443, 448

(56) References Cited

U.S. PATENT DOCUMENTS 1,226,152 A * 5/1917 Weslow
1,533,540 A * 4/1925 Craigen
2,015,284 A * 9/1935 Phelan
2,101,764 A * 12/1937 Swart
2,463,795 A * 3/1949 Neuzerling
2,492,423 A * 12/1949 Gray
2,525,738 A * 10/1950 Tormey
2,716,028 A * 8/1955 Yaeger
3,214,171 A * 10/1965 Luchsinger
3,433,478 A * 3/1969 Span
3,698,716 A * 10/1972 Rattey
3,782,726 A * 1/1974 Huffman
3,785,648 A * 1/1974 Kobayashi
3,856,298 A * 12/1974 Frantti
3,940,135 A * 2/1976 Cohen
4,012,040 A * 3/1977 Fernandes
4,076,242 A * 2/1978 Joseph
4,192,508 A * 3/1980 Livick
4,236,713 A * 12/1980 Moreno
4,382,600 A * 5/1983 Vieira
4,834,371 A * 5/1989 Hay
5,238,243 A * 8/1993 Grispi
6,076,827 A * 6/2000 Luchsinger

FOREIGN PATENT DOCUMENTS

BE 496824 * 11/1950 ..... 273/85 F

* cited by examiner

*Primary Examiner*—Sebastiano Passaniti
(74) *Attorney, Agent, or Firm*—George A. Seaby

(57) ABSTRACT

A magnetic table game includes a table having a smooth top playing surface, a goal at each end of the table, a projectile defined by a plastic ring carrying a freely rotatable steel ball bearing, and a pair of plastic sticks containing a magnet in their blade ends for insertion beneath the table to move the projectile along the playing surface.

6 Claims, 5 Drawing Sheets

MAGNETIC HOCKEY GAME

BACKGROUND OF THE INVENTION

1. Field of the Invention

This invention relates to a table game, and in particular to a magnetic table game.

The invention was intended as a table hockey game, but the same combination of elements can be used in a simulated soccer or other game including a projectile and goal. For the most part, the following description is directed to a table hockey game.

2. Discussion of the Prior Art

Table hockey games in which a plurality of miniature players are manipulated on a playing surface are well known. In such games, a marble or other simulated puck is propelled around the playing surface by moving the players so that the players or sticks integral with the players strike the puck. The players either remain in one position and rotate or can be moved a limited distance along the playing surface.

Magnetically operated table games are also described in the patent literature. Examples of such games are disclosed by Canadian Patent No. 832,328, issued to J. J. Beelien on Jan. 20, 1970, and U.S. Pat. Nos. 2,263,115, issued to L. A. Winter on Nov. 18, 1941; U.S. Pat. No. 2,716,028, issued to B. W. Yaeger on Aug. 28, 1955; U.S. Pat. No. 3,091,459, issued to G. E. Lindman on May 28, 1963, and U.S. Pat. No. 4,012,040, issued to G. Fernandez on Mar. 15, 1977. In general terms, the games include a table, the top surface of which defines a playing surface, and a plurality of player pieces which are magnetically manipulated on the playing surface by magnets in the players and/or activating sticks or handles beneath the table. In the case of table hockey games described in the patents, a simulated puck is propelled by forcibly moving a player against the puck.

GENERAL DESCRIPTION OF THE INVENTION

The object of the present invention is to provide a relatively amusing and challenging table game in which a projectile is directly manipulated by persons playing the game, rather than indirectly by simulated players on a playing surface.

Accordingly, the invention relates to a table game comprising a frame; legs for supporting said frame in an elevated position; a panel in said frame having a top surface defining a playing surface; a ferromagnetic projectile for sliding along said playing surface; at least one goal on said playing surface for receiving the projectile; and an elongated stick for moving the projectile on the playing surface, said stick including a handle end for manual manipulation of the stick and a magnetic end for movement beneath the panel to effect corresponding movement of the projectile on the playing surface.

More specifically, the invention relates to a table hockey game comprising a frame; legs for supporting said frame in an elevated position; a panel in said frame having a top surface defining a playing surface; a ferromagnetic puck for sliding along said playing surface; at least one goal on said playing surface for receiving the puck; and an elongated stick for moving the puck on the playing surface, said stick including a handle end for manual manipulation of the stick and a magnetic end for movement beneath the panel to effect corresponding movement of the puck on the playing surface.

BRIEF DESCRIPTION OF THE DRAWINGS

The invention is described below in greater detail with reference to the accompanying drawings, which illustrate a preferred embodiment of the invention, and wherein.

DESCRIPTION OF THE PREFERRED EMBODIMENT

Figure 1:
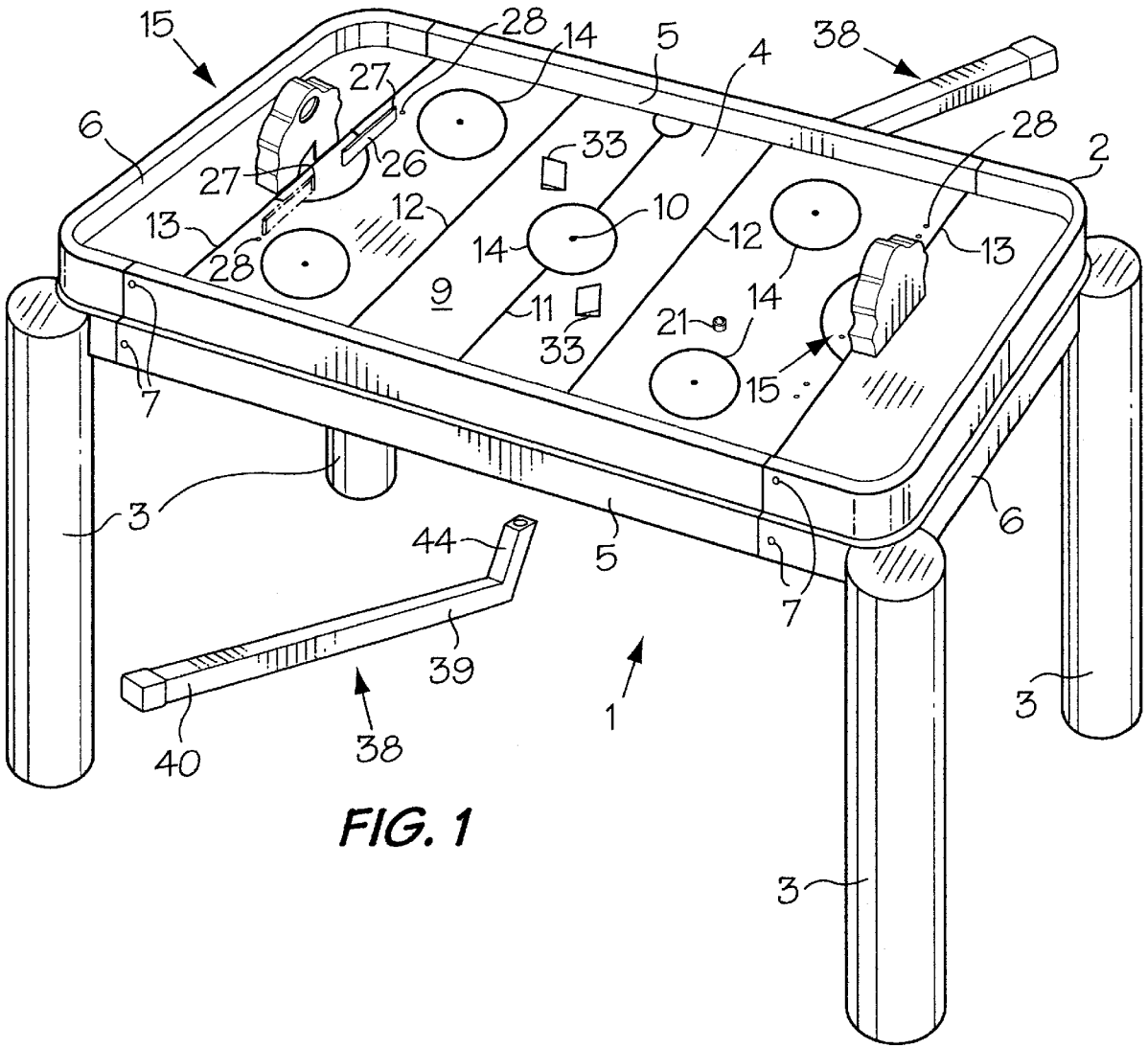
FIG. 1 is a perspective view of a table hockey game in accordance with the present invention as seen from above.
Figure 2:
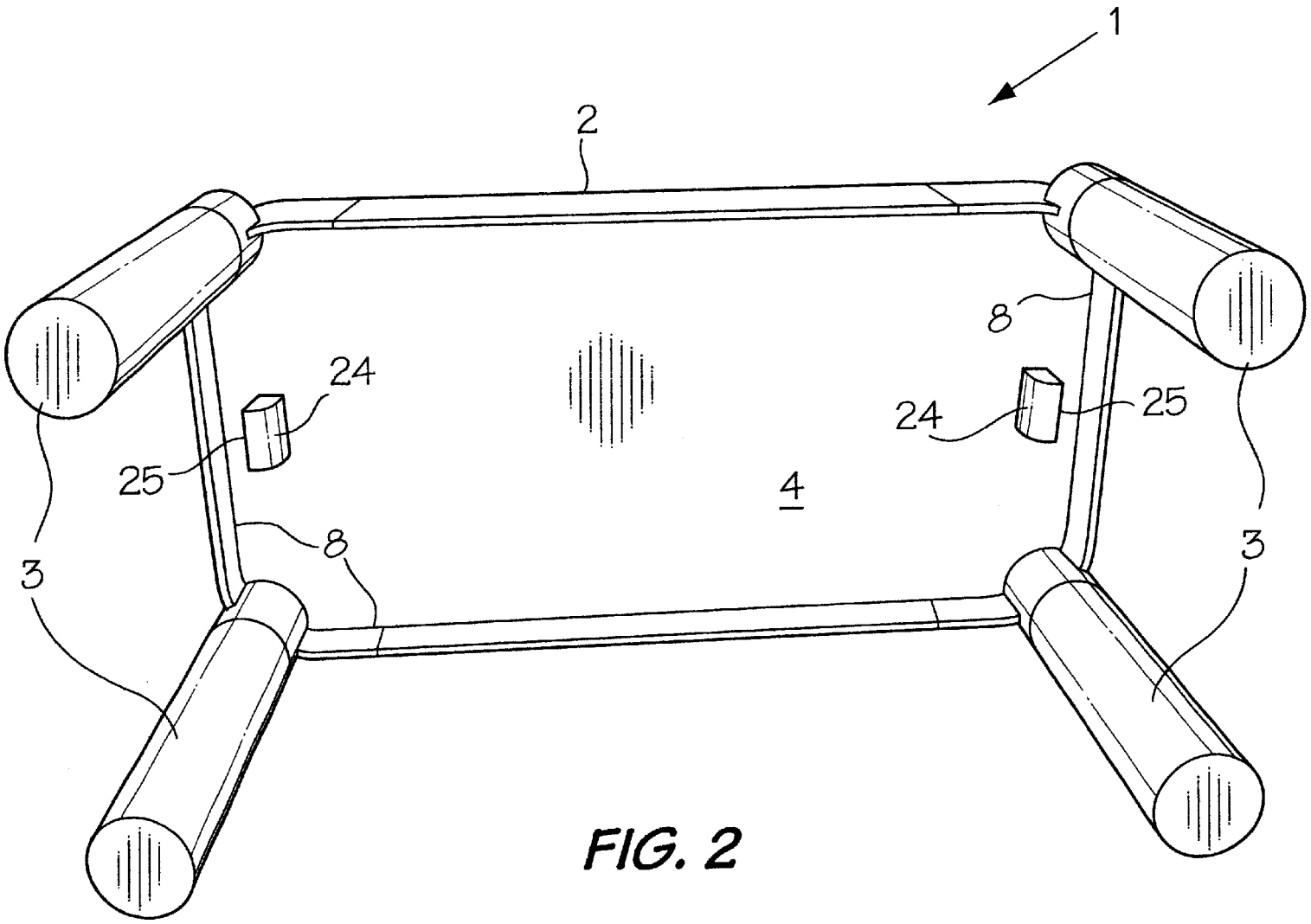
FIG. 2 is a perspective view of the game of FIG. 1 as seen from below.

Referring to FIGS. 1 and 2, a table hockey game in accordance with the invention includes a table indicated generally at 1. The table 1 is defined by a generally rectangular frame 2 supported in an elevated position by four legs 3 at the corners thereof, and a panel 4 in the frame 2. The frame 2 includes a pair of sides 5 and ends 6 connected to the sides by rivets 7. Ledges 8 (FIG. 2) on the sides 5 and the ends 6 support the panel 4. The panel is formed of Masonite (trade-mark) or plastic, and has a smooth top side defining a playing surface 9. The sides 5 and ends 6 of the frame 2 defined boards around the playing surface 9. Lines, circles and dots are painted on the playing surface 9 to represent, center ice 10, a center red line 11, blue lines 12, goal lines 13, and face-off circles 14.

Figure 3:
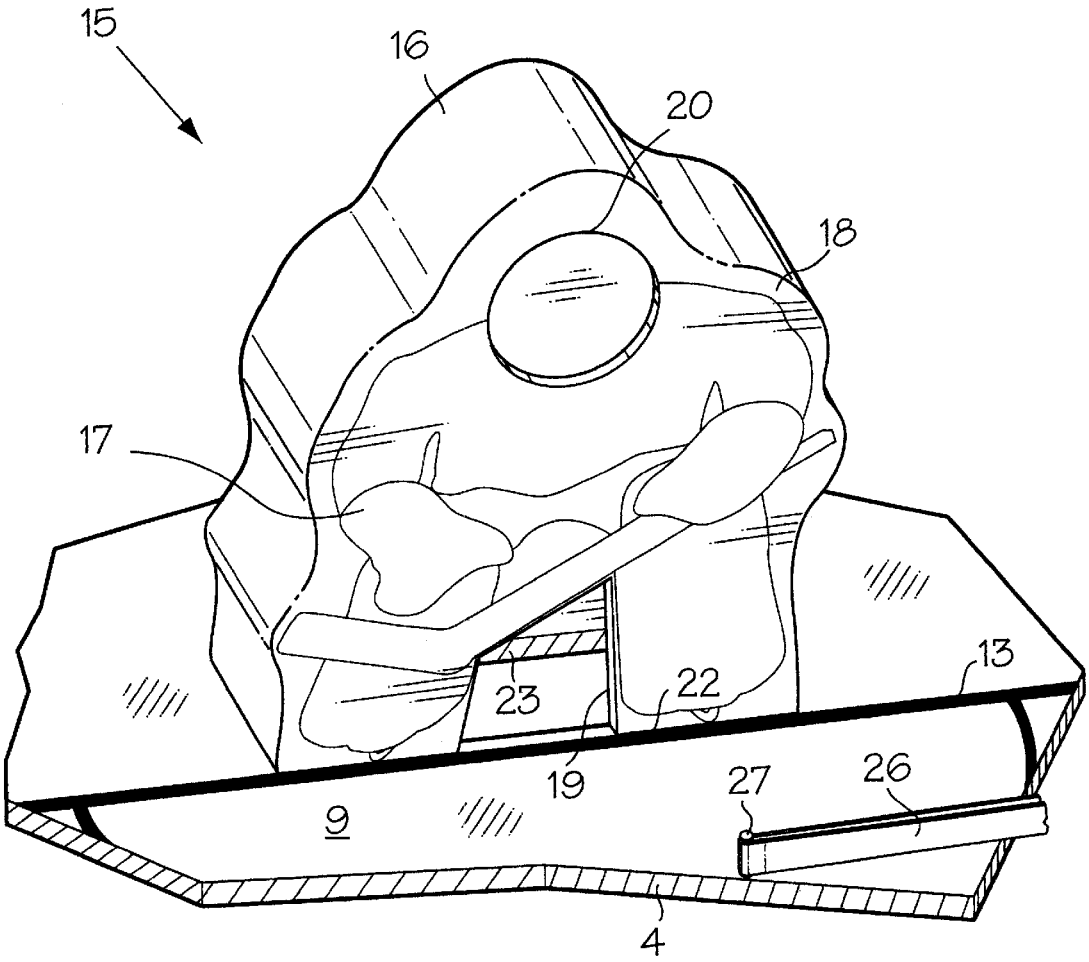
FIG. 3 is a perspective view of a goal used in the game of FIGS. 1 and 2.

A pair of goals, indicated generally at 15 are provided at the ends of the playing surface 9. As best shown in FIG. 3, each goal 15 is defined by a plastic container 16 having the general shape of a hockey goalkeeper. A picture 17 of a goalkeeper is painted on the front wall 18 of the container 16. An opening 19 is provided at the bottom of the front wall 18 between the goalkeeper's legs, and a second opening 20 is provided in the goalkeeper's head. The openings 19 and 20 define targets for a puck 21 described in greater detail below. The bottom end 22 of the container 16 is open, and the goalkeeper is placed over an opening 23 (FIG. 3) in the panel 4, so that the puck 21 entering the container can drop through the opening into a cup 24 (FIG. 2). The cup 24 has an open rear end 25 permitting retrieval of the puck 21 from the cup each time a goal is scored.

As shown in FIG. 1, access to one or both of the goals 15 can be restricted by fences removably mounted on the playing surface 9. Each fence includes a rubber band 26 mounted on pins 27 which are inserted into holes or recesses 28 in the top of the panel 4. A plurality of spaced apart recesses 28 are provided in a row, so that the positions of the fences can be changed to alter the length of the gap between the fences and consequently to limit access to the goal 15.

Figure 4:
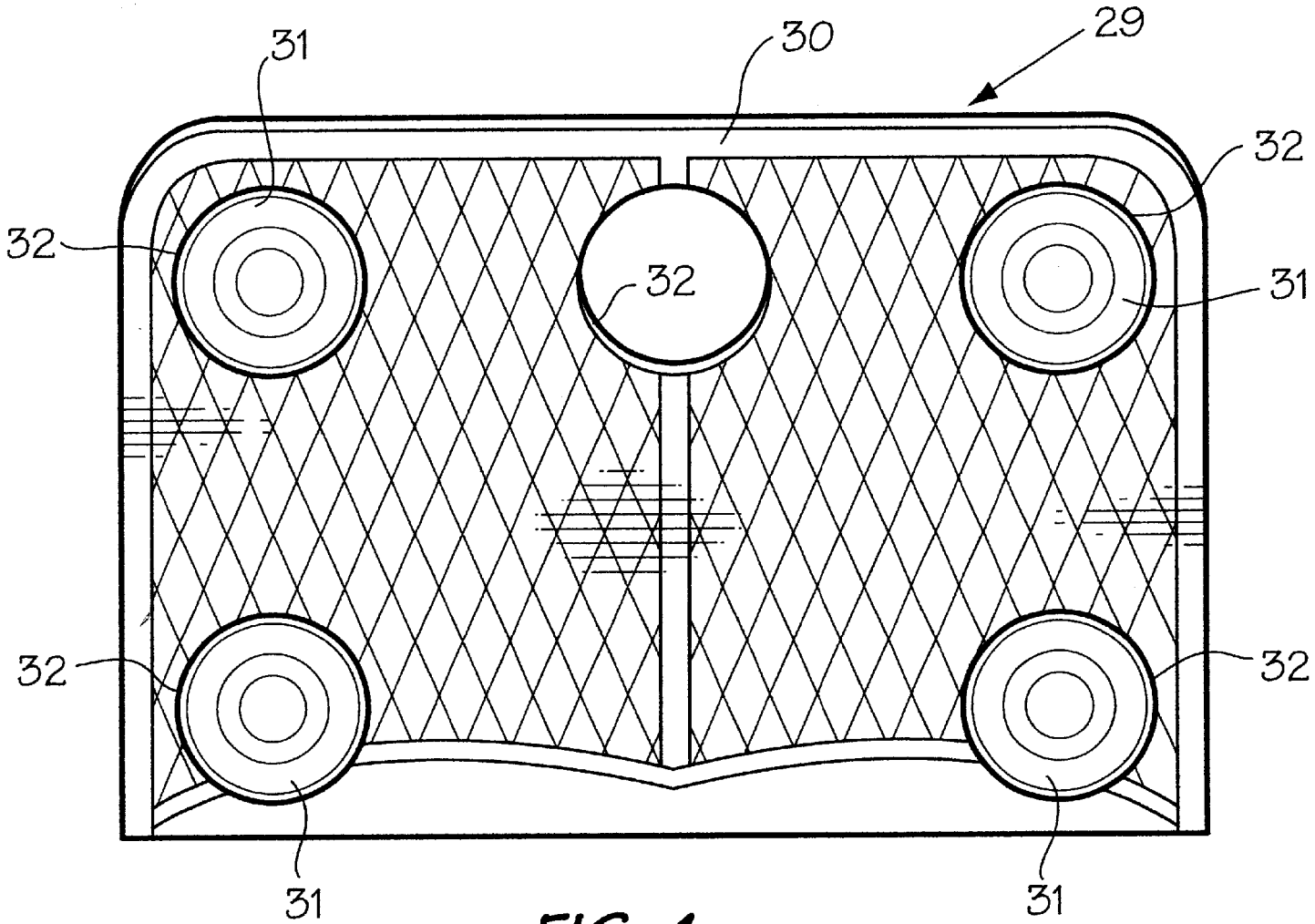
FIG. 4 is a front view of an alternate goal used in the game of FIGS. 1 and 2 and FIG. 5 is a partly sectioned side view of one end of a stick and a puck used in the game of FIGS. 1 and 2.

With reference to FIG. 4, an alternative goal is defined by a target indicated generally at 29, which can be placed in front of and spaced apart from one of the goalkeepers 15 for shooting practice by one or more players. The target 29 includes a generally rectangular panel 30 with a picture of a hockey net painted thereon, and thereon, and five bull's-eyes (four shown) on discs 31 which are releasably mounted in openings 32 in the panel 30. When a puck 21 strikes one of the discs 31, the disc is knocked out of the panel, but can be replaced for additional practice.

A pair of wedge-shaped ramps 33 (FIG. 1) are provided on the playing surface 9 for giving the puck 21 loft, i.e. for raising the puck. The ramps 33 are made of injection molded plastic. One ramp 33 is inclined upwardly towards one goal 15, and the other ramp is inclined towards the other goal 15.

Figure 5:
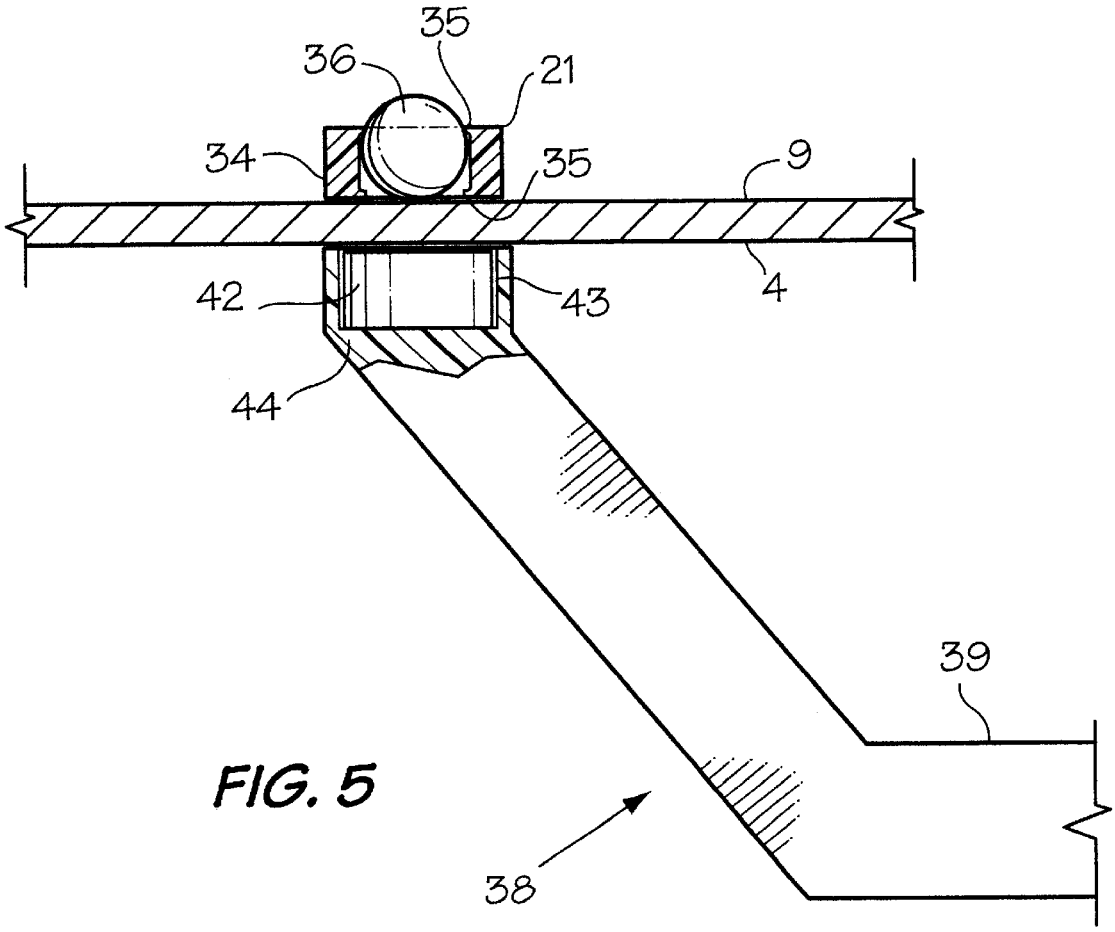

Referring to FIG. 5, the puck 21 is defined by a plastic sleeve 34 with radially inwardly extending flanges 35 on the ends thereof retaining a steel (ferromagnetic) ball 36 therein. As a practical matter, a steel ball bearing is used for the ball 36. The flanges 35 permit free rotation and limited vertical movement of the ball 36 in the sleeve 34, so that the puck 21 slides smoothly along the playing surface 9. From FIG. 5, it will be noted that the top flange 35 is the only portion of the sleeve 34 contacted by the ball 36 when the puck is in use.

The puck 21 is propelled along the playing surface 9 by a stick generally indicated at 33 (FIGS. 1 and 5). The stick 38 includes an elongated, square cross section, plastic body 39 with a shape resembling that of a regular hockey stick. One end 40 (FIG. 1) of the body 39 defines a handle for manual manipulation of the stick 38 beneath the table 1. A disc-shaped permanent magnet 42 is mounted in a well 43 in the other end 44 of the body 39. The magnet is preferably an Nd—Fe—B magnet. The magnet 42 is glued in the well 43. However, resilient flanges or tabs (not shown) could be provided at the top end of the well for retaining the magnet therein.

Normally, the hockey game is played by two players (not shown) who position themselves on opposite sides of the table 1. The puck 21 is placed on center ice 10 and the players move their sticks 38 in an attempt to gain control of and move the puck 21. The puck 21 is moved by drawing the magnet 42 along the bottom surface of the panel 4 with the puck in vertical alignment with the magnet. When the stick 38 is moved abruptly downwardly, the puck 21 continues to move horizontally in the direction the stick was moving. When the puck 21 is moved rapidly up a ramp 33, the ball 36 is released by the magnet, and the puck becomes airborne.

It will be appreciated that when the game is in the form of a soccer game, the markings on the playing surface and the goals will resemble those found on an actual soccer field.

We claim:

1. A table game comprising a frame; legs for supporting said frame in an elevated position; a panel in said frame having a top surface defining a playing surface; a ferromagnetic projectile for sliding along said playing surface; said projectile including a cylindrical sleeve, a steel ball bearing rotatable in said sleeve, and annular, inwardly extending flanges on inner ends of said sleeve retaining said ball bearing in the sleeve; at least one goal on said playing surface for receiving the projectile; and an elongated stick for moving the projectile on the playing surface, said stick including a handle end for manual manipulation of the stick and a magnetic end for movement beneath the panel to effect corresponding movement of the projectile on the playing surface.

2. The table game of claim 1, including a disc-shaped permanent magnet in said magnetic end of said stick for sliding contact with the bottom of said panel.

3. The table game of claim 2, wherein said magnet is an Nd—Fe—B magnet.

4. The table game of claim 1, including at least one ramp for mounting on said playing surface for giving loft to the puck when the puck is moved up the ramp.

5. The table hockey game of claim 1, wherein said goal includes a hollow container in the shape of a hockey goalkeeper for receiving the puck.

6. The table hockey game of claim 5, including aligned holes in the bottom of said goalkeeper and in said panel, whereby, after a goal is scored when the puck enters the container, the puck can drop through the panel for retrieval.

* * * * *